US006345483B1

(12) United States Patent
Clark

(10) Patent No.: US 6,345,483 B1
(45) Date of Patent: Feb. 12, 2002

(54) WEBBED REINFORCING STRIP FOR CONCRETE STRUCTURES AND METHOD FOR USING THE SAME

(75) Inventor: Timothy L. Clark, Lilburn, GA (US)

(73) Assignee: Delta-Tie, Inc., Ames, IA (US)

( * ) Notice: Subject to any disclaimer, the term of this patent is extended or adjusted under 35 U.S.C. 154(b) by 0 days.

(21) Appl. No.: 09/398,637

(22) Filed: Sep. 17, 1999

(51) Int. Cl.[7] ..... E04C 5/07

(52) U.S. Cl. ..... 52/649.1; 52/664; 52/309.16; 428/105; 428/108; 428/113

(58) Field of Search ..... 52/649.1, 664, 52/649.8, 309.16, 309.17, 646.1, 660; 428/105, 113, 408, 902, 245, 257

(56) References Cited

U.S. PATENT DOCUMENTS

| | | | | |
|---|---|---|---|---|
| 3,284,980 A | | 11/1966 | Dinkel | |
| 3,949,144 A | | 4/1976 | Duff | |
| 4,264,542 A | | 4/1981 | Magnus | |
| 4,519,177 A | | 5/1985 | Russell | |
| 4,578,301 A | | 3/1986 | Currie et al. | |
| 4,617,219 A | | 10/1986 | Schupack | |
| 4,619,857 A | | 10/1986 | Gmur | |
| 4,706,430 A | * | 11/1987 | Sugita et al. | 52/309.16 |
| 4,715,560 A | | 12/1987 | Loyek | |
| 4,793,892 A | | 12/1988 | Miller et al. | |
| 4,819,395 A | * | 4/1989 | Sugita et al. | 52/309.16 |
| 4,910,076 A | * | 3/1990 | Ando et al. | 428/245 |
| 4,990,390 A | * | 2/1991 | Kawaaski et al. | 428/113 |
| 5,025,605 A | * | 6/1991 | Sekijima et al. | 52/309.16 |
| 5,251,420 A | * | 10/1993 | Johnson | 52/664 |
| 5,768,847 A | | 6/1998 | Policelli | |
| 5,795,267 A | | 8/1998 | Weaver | |
| 6,123,879 A | * | 9/2000 | Hendrix et al. | 264/31 |
| 6,233,890 B1 | * | 5/2001 | Tonyan | 52/302.3 |

* cited by examiner

*Primary Examiner*—Carl D. Friedman
*Assistant Examiner*—Yvonne M. Horton
(74) *Attorney, Agent, or Firm*—Zarley, McKee, Thomte, Voorhees & Sease, PLC

(57) ABSTRACT

A webbed reinforcing strip for poured concrete structures includes a first elongated tension strand, a second elongated tension strand spaced apart from and substantially parallel to the first tension strand, and at least two pairs of strands interconnecting the first and second tension strands in an open weave pattern. The interconnecting strands cross each other between the tension strands to form a webbed central portion of the strip. The interconnecting strands bend to join the tension strands at nonperpendicular angles at a plurality of nodes. All strands are formed of glass fiber reinforced plastic material and are bonded together with a bonding resin. Thus, thermal transfer and the potential for damage due to corrosion are minimized.

19 Claims, 5 Drawing Sheets

WEBBED REINFORCING STRIP FOR CONCRETE STRUCTURES AND METHOD FOR USING THE SAME

BACKGROUND OF THE INVENTION

The present invention relates to the field of poured concrete structures. In particular, the invention relates to a non-metallic web reinforcing strip for poured concrete structures. The invention is especially useful when the concrete structure in which it is incorporated is likely to be subjected to a corrosive environment.

It is conventional to reinforce poured concrete structures with prefabricated rigid metal bars (commonly known as "rebar"), semi-rigid steel meshes, and the like. However, metal reinforcing structures present problems when a corrosive environment confronts the concrete structure. For example, bridge decks in coastal areas are often exposed to corrosive seawater and mists. Snow and ice removal materials can also be corrosive. Because they are metallic, corrosion can affect the reinforcing structures, causing them to weaken and expand with oxide buildup. The resulting expansion of the metal reinforcing means can cause the surrounding concrete to crack and fail under heavy loads.

Galvanizing or coating the metal reinforcing structures with epoxy coatings reduces the risk of corrosion but greatly increases the cost of the reinforcing structures. Fixed length rigid glass reinforced resin (GFR) bars are available as alternatives to metal reinforcing structures, but such bars must be completely fabricated in the desired shape at the factory and cannot be bent or reshaped in the field later.

Therefore, a primary objective of the present invention is the provision of a nonmetallic webbed reinforcing strip for poured concrete structures that is an improvement over existing reinforcing structures used in such concrete structures.

A further objective of this invention is the provision of a reinforcing strip that is a nonmetallic and the therefore resistant to corrosion.

A further objective of this invention is the provision of a nonmetallic webbed reinforcing strip that is strong, compact, economical to manufacture, and easy to install.

These and other objectives will become apparent from the drawings, as well as from the description and claims which follow.

SUMMARY OF THE INVENTION

The webbed reinforcing strip of this invention includes a first elongated tension strand, a second elongated tension strand spaced apart from and substantially parallel to the first tension strand, and at least two pairs of strands interconnecting the first and second tension strands in an open weave pattern. The interconnecting strands cross each other between the tension strands to form the webbed central portion of the strip. The interconnecting strands bend to join the tension strands at non-perpendicular angles at a plurality of connection nodes. All strands are formed of a glass fiber reinforced material bonded together with a plastic resin. Thus, thermal transfer and the potential for damage due to corrosion are minimized.

Such strips can be used as reinforcements in a variety of poured concrete structures, including slabs and columns. The strips can be chaired and tied into the forms before the concrete is poured. The reinforcing strip of this invention is nonmetallic so that it can withstand corrosive environments better than steel reinforcing bars or mesh.

DETAILED DESCRIPTION OF THE PREFERRED EMBODIMENT

Figure 1:
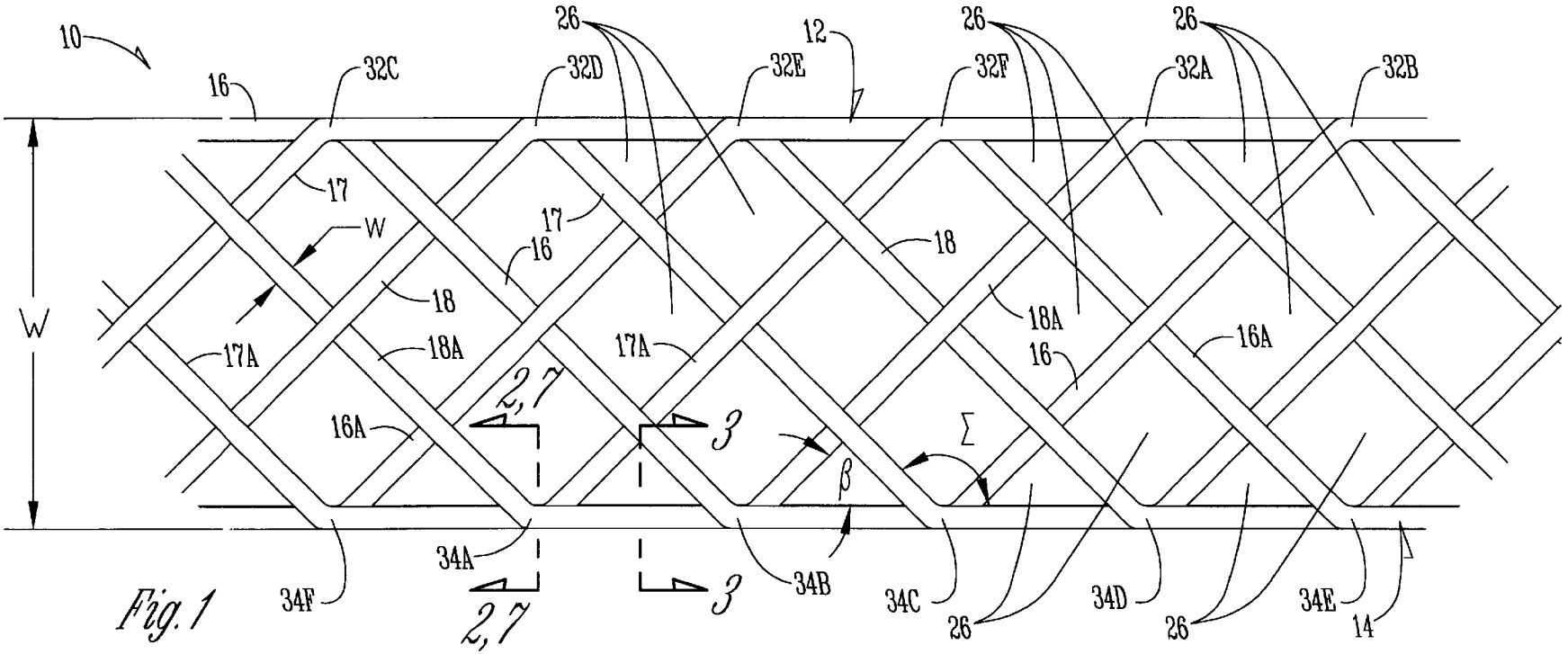
FIG. 1 is a top plan view of the reinforcing strip of this invention.

In the drawings and the description which follows, like features are denoted with like reference numerals.

Figure 2:
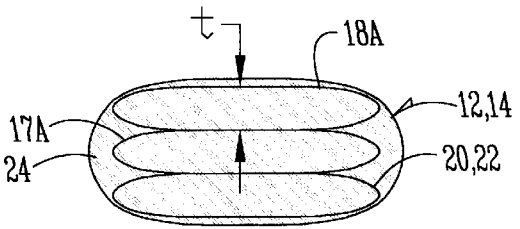
FIG. 2 is a transverse cross sectional view taken along line 2—2 in FIG. 1 and shows in greater detail a typical node that occurs along one of the strand bundles of the reinforcing strip.
Figure 3:
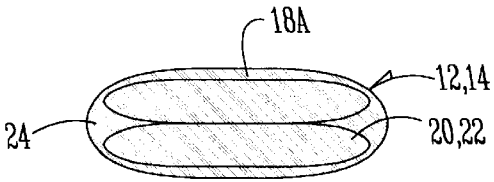
FIG. 3 is a transverse cross sectional view taken along line 3—3 in FIG. 1 and shows how the strand bundle is configured between between the nodes.
Figure 7:
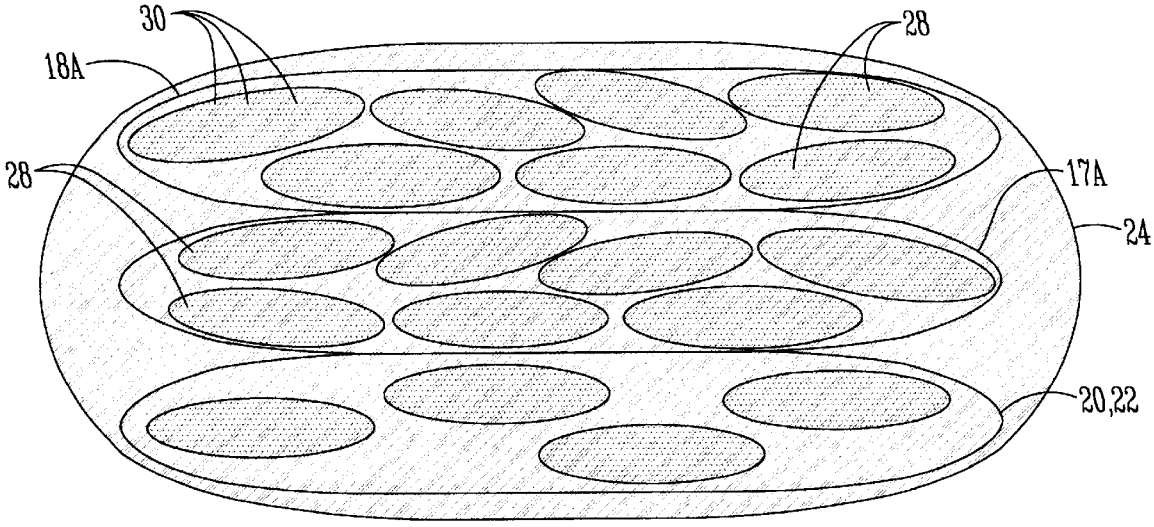
FIG. 7 is an enlarged cross sectional view similar to FIG. 2 but shows how the strands themselves include a plurality of individual rovings and glass fibers.

The elongated strip of this invention is generally designated by the reference numeral 10 in the drawings. FIG. 1 shows that the elongated strip 10 includes a pair of spaced apart and generally parallel, elongated first and second strand bundles 12, 14. As can be seen in FIGS. 2, 3 and 7, the first and second strand bundles 12, 14 are actually formed by bringing together a plurality of individual elongated glass strands 16, 17, 18, and 16A, 17A, 18A with straight and continuous tension strands 20, 22 and bonding them together with a vinyl ester plastic resin 24. Although the section lines only extend through the second strand bundle 14 in FIG. 1 to form FIGS. 2, 3 and 7, the first strand bundle 12 is configured essentially identical at some point along the reinforcing strip 10. Thus, reference numerals are included on FIGS. 2, 3 and 7 relating to both of the strand bundles 12, 14, and the respective tension stands 20, 22.

Referring to FIGS. 1–3, 5 and 7, tension strands 20, 22 are interconnected by the strands 16, 17, 18, 16A, 17A, 18A in a loosely woven six strand "open" weave pattern. The pattern of the weave is best understood by studying FIG. 1. In the central web portion of the strip 10 the interconnecting strands 16, 17, 18, 16A, 17A, 18A extend at non-perpendicular angles with respect to the tension strands 20, 22. The interconnecting strands 16, 17, 18, 16A, 17A, 18A cross each other, and preferably weave alternately over and under each other, between the tension strands 20, 22 so as to define spaces 26 therebetween.

The open weave pattern repeats itself along the length of the spaced apart tension strands 20, 22 to define the strand bundles 12, 14 and form the central web portion of the reinforcing strip 10. A plurality of nodes 32A, 32B, 32C, 32D, 32E, 32F and 34A, 34B, 34C, 34D, 34E, 34F are formed along the strand bundles 12, 14 where the strands 16, 17, 18, 16A, 17A, 18A join the respective tension strands 20, 22. The nodes 34A, 34B, 34C, 34D, 34E, 34F are described in greater detail below to facilitate a better understanding of the open weave pattern. The nodes 32A, 32B, 32C, 32D, 32E, 32F are essentially the same as the nodes 34A, 34B, 34C, 34D, 34E, 34F and therefore will not be separately described herein.

Referring to the second strand bundle 14 at node 34A in the lower portion of FIG. 1, a strand 18A is matrix bonded with a vinyl ester resin 24 or otherwise suitably joined to the tension strand 22. At node 34A, the strand 18A bends upward or forward at an included (entry) angle Σ to join strand 22 (see FIG. 2) and then extends co-extensively with it from node 34A to node 34B (see FIG. 3). Meanwhile at node 34A in FIG. 1, one of the other interconnecting strands 17A that had been joined with the tension strand 22 at node 34F (immediately adjacent node 34A) bends upward or forward at an (exit) angle β and extends toward the node 32F found in the upper portion of the figure. Thus, for a short distance (approximately the width of the node 32A) all three strands 22, 17A, and 18A are joined together or fused together and extend co-extensively. A similar node structure exists at the other nodes and between the nodes with their respective strands.

At node 34B, the strand 18A exits at an angle β and another strand 16 enters at an angle Σ. The strand 16 joins the tension strand 22 and extends with it to node 34C. Another strand 17 joins the tension strand 22 at node 34C and strand 16 exits. Thus, as exemplified in FIG. 2, three strands are always joined together at the nodes. Two strands are always joined together between the nodes, as exemplified in FIG. 3.

As best seen in FIG. 7, each of the strands 16, 17, 18, 16A, 17A, 18A, 20, 22 are formed of a plurality of individual glass rovings 28 bonded together by plastic resin 24. The glass rovings 28 themselves are conventional and include a plurality (probably thousands) of loosely grouped glass fibers or filaments 30 generally aligned with each other so that they extend in the same general direction. Preferably, the rovings 28 and the glass fibers 30 therein extend longitudinally along the elongated strands 16, 17, 18, 16A, 17A, 18A, 20, 22. The interconnecting strands 16, 17, 18, 16A, 17A, 18A include approximately four to seven rovings, while the tension strands 20, 22 typically include two to four rovings.

The angles Σ and β must be blunt enough to allow for proper matrix bonding and avoid "matrix starvation" in the node areas. The proper angle ensures that the glass fibers will maintain higher resin cover and reduces stress concentrations in the glass fibers. The entry angle Σ is preferably approximately 135 degrees. The exit angle β is preferably approximately 45 degrees. Preferably the entry angle and the exit angle are complementary and add to 180 degrees. Thus, in the preferred embodiment as understood in view of FIGS. 1 and 7, the glass rovings 28 in the strands are arranged and bonded to each other at a angle of approximately 45 degrees relative to each other at the nodes.

The strip 10 is preferably about 2–2½ inches wide across the strand bundles 12, 14, although other widths will not detract from the invention. If the width across the strand bundles 12, 14 is W, the width w of strands 16, 17, 18, 16A, 17A, 18A, 20, 22 is preferably approximately W/4 to W/32, more preferably approximately W/16. In the preferred embodiment shown in FIG. 1, the strands 12, 14, 16, 17, 18, 16A, 17A, 18A, 20, 22 have a thickness t of about ⅛–3/16 inch and a width w of about 3/16 inch. The open space 26 between strands is preferably no smaller than the width w of the strands.

The strands 12, 14, 16, 17, 18, 16A, 17A, 18A, 20, 22 are formed of glass fiber reinforced plastic (GFR). The glass fibers are made of an alkali and temperature resistant material, such as E-glass™ which is available from Dow Corning. The bonding resin is preferably a vinyl ester resin. The materials can be put together manually using jigs or in a continuously woven "pull trusion" n a removable mandrel.

The strands 12, 14, 16, 17, 18, 16A, 17A, 18A, 20, 22 are formed of glass fiber reinforced plastic (GFR). The glass fibers are made of an alkali and temperature resistant material, such as E-glass™ which is available from Dow Corning. The bonding resin is preferably a vinyl ester resin. The materials can be put together manually using jigs or in a continuously woven "pull trusion" on a removable mandrel.

The glass fiber content of the tension strands 20, 22 is preferably about 25% less than the glass fiber content of the strands 16, 17, 18, 16A, 17A, 18A. The tension strands 20, 22 contain approximately 50–60% glass and 50–40% resin, whereas the interconnecting strands 16, 17, 18, 16A, 17A, 18A contain approximately 70–75% glass and 30–25% resin. This makes the tension strands 20, 22 somewhat more flexible than the central web portion of the strip 10.

The glass fiber content of the tension strands 20, 22 is preferably about 25% less than the glass fiber content of the strands 16, 17, 18, 16A, 17A, 18A. The tension strands 20, 22 contain approximately 50–60% glass and 50–40% resin, whereas the interconnecting strands 16, 17, 18, 16A, 17A, 18A contain approximately 70–75% glass and 30–25% resin. This makes the tension strands 20, 22 somewhat more flexible than the central web portion of the strip 10. The tension strands 20, 22 function to resist stretching of the strip 10 longitudinally or compressing of the strip 10 transversely during fabrication, handling and installation. Strands 20, 22 also facilitate fabrication by providing continuous straight cords around which strands 16, 17, 18, 16A, 17A, 18A can be wound more readily.

Figure 8:
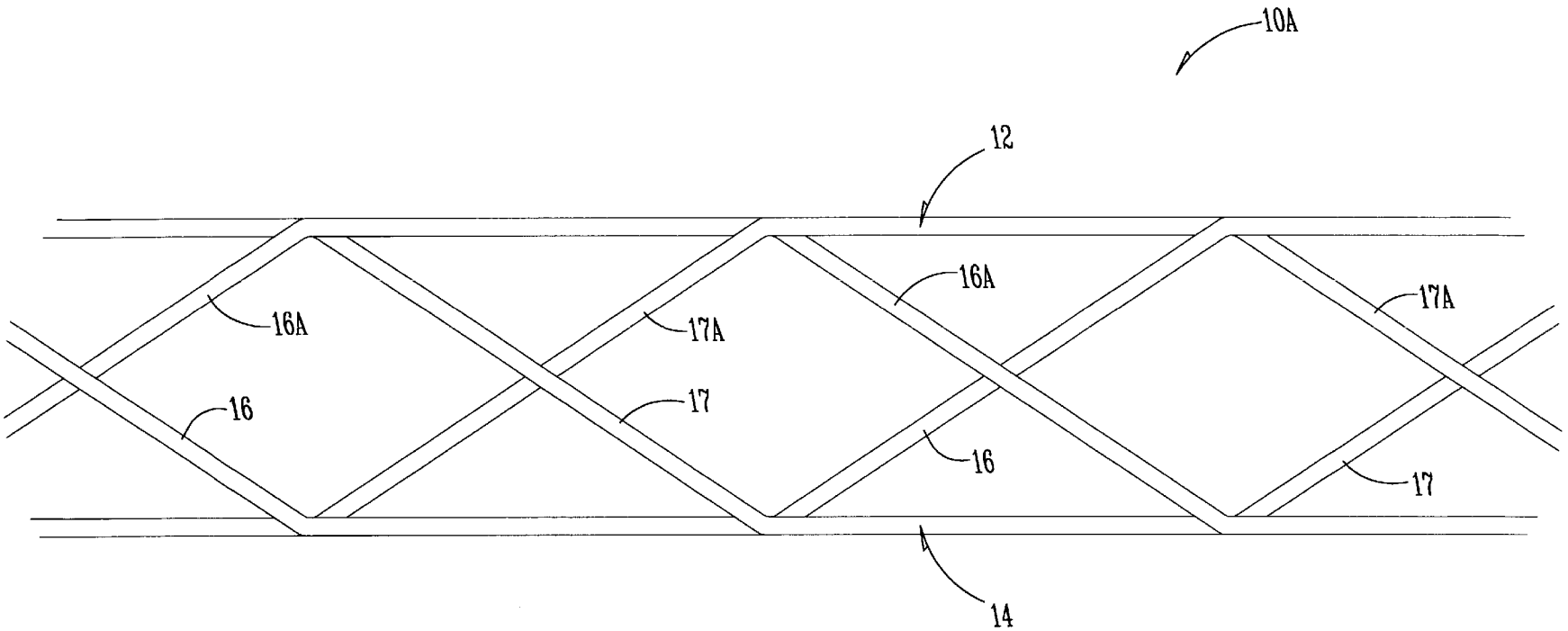
FIG. 8 is a top plan view similar to FIG. 1 and shows an alternative embodiment of the reinforcing strip of this invention.

FIG. 8, a four strand open weave embodiment of the present invention is shown. The strip 10A has a looser weave and bigger voids than the six strand embodiment of FIG. 1. The angles Σ and β are also different.

It is contemplated that, in other embodiments, the bend angles Σ and β could be different for the different interconnecting strands or even different at the respective tension strands 20, 22. The spacing and the size of the spaces 26 would then be less regular.

Figure 4:
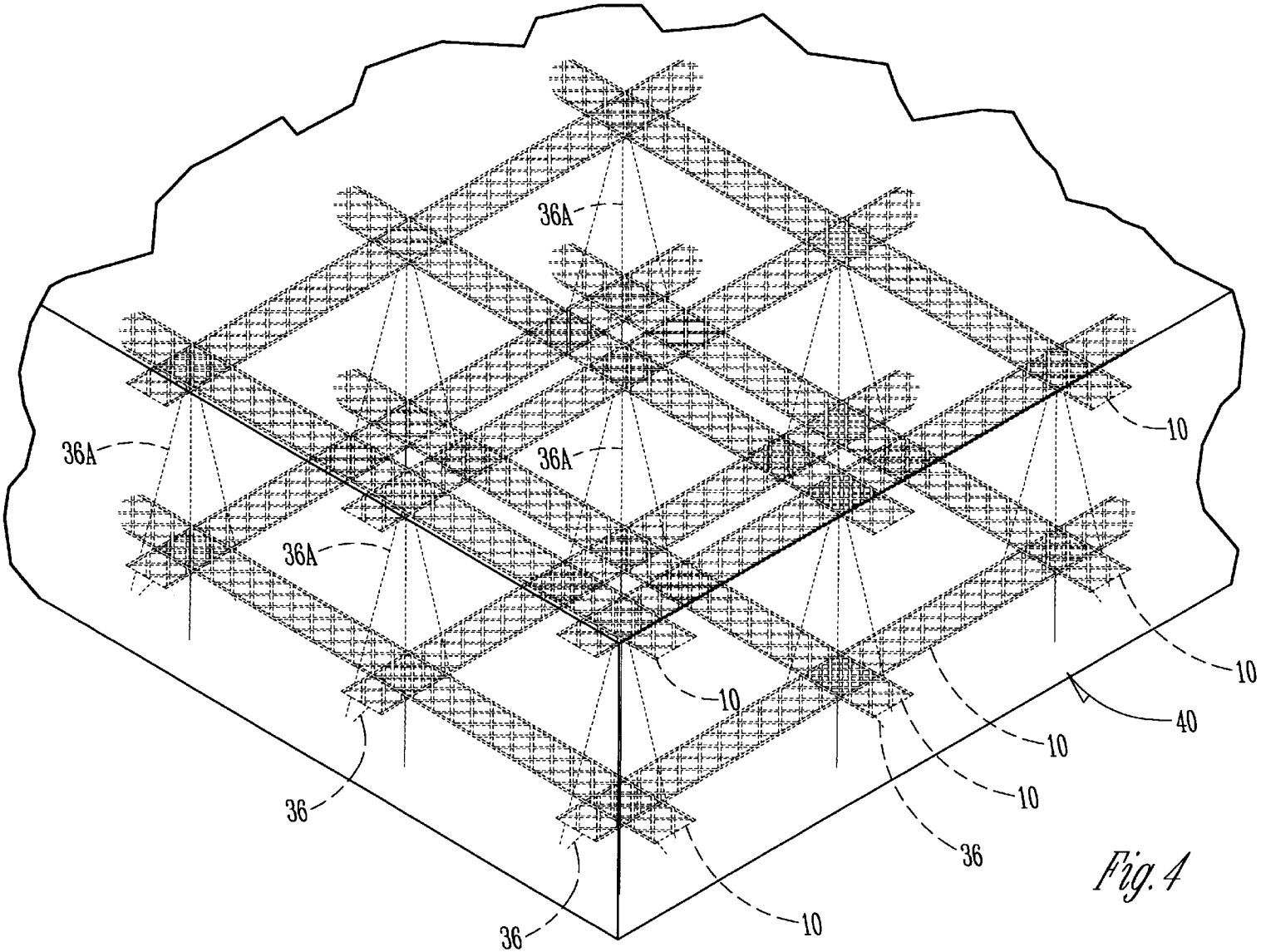
FIG. 4 is a perspective view of a slab of concrete with the reinforcing strip(s) of the present invention of incorporated in therein.
Figure 5:
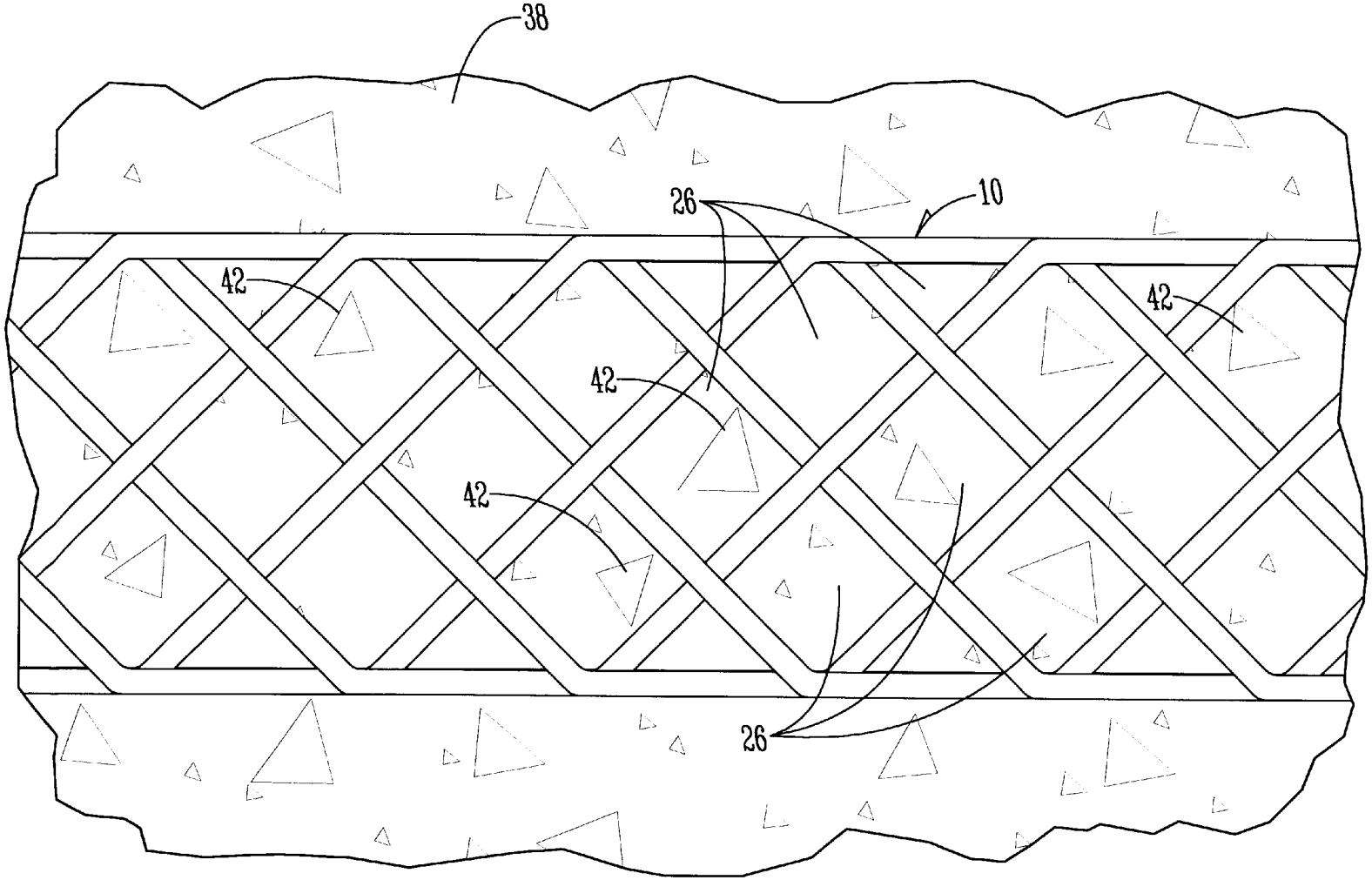
FIG. 5 is a top plan view similar to FIG. 1 but shows how concrete with aggregates therein can flow freely through the spaces between the strands of the reinforcing strip.

In use, according to FIG. 4, the strip 10 is supported by and tied to a plurality of chairs 36 or 36A that rest on the ground or on the bottom of a conventional form (not shown) for receiving concrete 38. The chairs 36, 36A position the strip 10 about three-quarters to 1.5 inches, more preferably about one inch, from the bottom or top of the concrete slab 40, respectively. A plurality of strips 10 can be arranged in criss-crossing grid pattern as shown.

Figure 6:
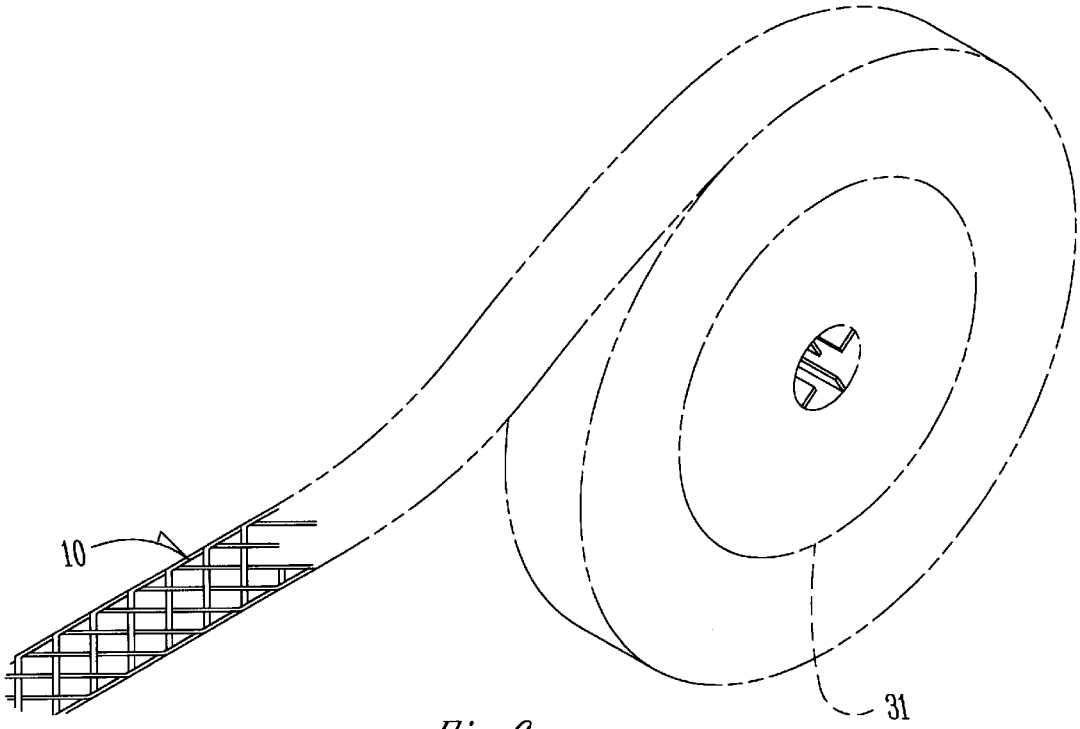
FIG. 6 is a perspective view of one embodiment of the strip of this invention that can be dispensed from a reel.

As construction personnel pour the concrete 38 into the form, the concrete 38 and even the aggregate 30 contained therein flow through the spaces 26 in the strip 10. When the concrete 38 dries or cures into a concrete slab 40, the concrete is fully developed around the strands 16, 17, 18, 16A, 17A, 18A, 20, 22 and the strip 10 is thereby firmly held in place. See FIG. 6. The spaces 26 are preferably large enough to allow commonly used concrete aggregates to pass through the strip 10 when the concrete is wet.

Three-quarter inch and one inch aggregates 42 are often specified or required by governing building codes or by the American Concrete Institute (ACI). Therefore, the spaces 26 are preferably more than three-quarters of an inch square, and more preferably about one inch square. Of course, the size of the spaces 26 can be set to allow almost any size aggregate 42 to pass through. The strips 10 reinforce the slab 40 in substantially the same way that steel rebar does, but are more lightweight, easier to cut and bend in the field, and more resistant to corrosion. The strips 10 avoid the problems associated with the formation of ferrous oxides in the concrete.

The use of the semi-rigid embodiment of the reinforcing strip 10 of this invention is not limited to rectangular slabs. The flexible reinforcing strip 10 can be bent, cut, and/or tied into a variety of shapes. Therefore, the strip 10 can be bent into a hoop and tied as secondary reinforcements into forms for beams or columns having circular or rectangular cross sections.

Another advantageous feature of the present invention is that the web strip bar is not matrix dependent. The strands are "woven" around the concrete, thus the glass is always directly in tension or compression without being dependent upon horizontal shear with the thermal matrix. The matrix is minimum in volume in the strands and in the strip 10, and maximum in "flex". Conventional flex additives are available in the fiber glass industry. Such flex additives provide the desired flexibility while securely bonding the rovings and the strands.

The open weave pattern of the reinforcing strip 10 increases the portion of its surface area which is in contact with the concrete matrix. The shape of the reinforcing strip is essentially a flat oval, very similar to a woven leather belt. This shape increases the surface-area-to-cross-section-area of the strip 10. This shape is also advantageous in bending (i.e. field fabrication). Bending can occur around the transverse width axis. The flat oval shape of the strip 10 also allows maximum concrete cover (i.e., the thickness of concrete from the exterior surface of the concrete slab to the surface of the nearest reinforcing strip 10). See FIG. 4.

This reinforcing strip 10 can be utilized in corrosive environments, i.e., salts (marine de-icing, manufacturing), chlorides (manufacturing), acids (manufacturing and soils), and caustics (manufacturing). This G.F.R. reinforcing strip 10 can be utilized in construction systems where galvanized or epoxy-coated metal reinforcements or rigid G.F.R. bars are currently specified. The reinforcing strip 10 of this invention can replace #3, #4, and #5 steel and G.F.R. bars. Such bar sizes represent nearly all secondary reinforcements (temperature steel, stirrups, and ties).

Therefore, it can be seen that the present invention at least achieves its stated objectives.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An apparatus for reinforcing a poured concrete structure comprising:

a first elongated tension strand;

a second elongated tension strand spaced apart from and substantially parallel to the first tension strand;

at least two pairs of strands interconnecting the first and second tension strands in an open weave pattern and thereby forming a plurality of connection nodes along the first and second strands, the interconnecting strands being rigidly joined to the first and second tension strands and extending therebetween at non-perpendicular entry and exit angles with respect to the first and second tension strands, the interconnecting strands crossing each other between the first and second tension strands so as to define a webbed central portion and at least one void between the first and second tension strands;

the first and second tension strands and the interconnecting strands all being formed of a glass fiber reinforced resin-bonded material and a bonding resin rigidly joining each of the interconnecting strands to the first and second tension strands at the nodes;

whereby a single unitary elongated strip is formed by the first and second tension strands and the interconnecting strands.

2. apparatus of claim 1 wherein one of the interconnecting strands joins one of the first and second tension strands at the entry angle at one of the nodes, then joins and coextends with said one of the first and second tension strands to form an integral strand bundle at and between said one of the nodes and an adjacent node, then departs from the integral strand bundle toward the other of the first and second strand at the exit angle at the adjacent node.

3. The apparatus of claim 1 wherein at least some of the interconnecting strands are parallel to each other and spaced apart more than three-quarters of an inch in the central webbed portion.

4. The apparatus of claim 1 wherein at least some of the interconnecting strands are parallel to each other and spaced approximately one inch apart in the central webbed portion.

5. The apparatus of claim 1 wherein the entry angle is approximately 135 degrees.

6. The apparatus of claim 1 wherein the exit angle is approximately 45 degrees.

7. The apparatus of claim 1 wherein the at least some of the interconnecting strands extend generally parallel to each other between the first and second tension strands and other of the interconnecting strands cross each other.

8. The apparatus of claim 1 wherein the elongated webbed strip is formed by orienting the first and second tension strands and the interconnecting strands and adding the bonding resin to all of the strands in a continuous woven pull trusion process.

9. The apparatus of claim 1 wherein the bonding resin is a vinyl ester resin.

10. The apparatus of claim 1 wherein the first and second tension strands and the interconnecting strands include a plurality of elongated glass rovings, each roving comprising a plurality of glass fibers that are alkali resistant.

11. The apparatus of claim 1 wherein the strip is substantially rigid and approximately forty feet long.

12. The apparatus of claim 1 wherein the strip is a semi-rigid strip wound on a reel so that the semi-rigid strip can be dispensed and cut to a desired length.

13. The apparatus of claim 1 wherein said at least two pairs of interconnecting strands comprises six interconnecting strands.

14. The apparatus of claim 1 wherein said least two pairs of interconnecting strands comprises four interconnecting strands.

15. The apparatus of claim 1 wherein the strip is substantially flexible about an axis generally transverse to the first and second tension strands.

16. An apparatus for reinforcing a poured concrete structure comprising:

a first elongated tension strand;

a second elongated tension strand substantially parallel to and spaced apart from the first tension strand;

a plurality of interconnecting strands transversely interconnecting the first and second tension strands in an open weave pattern at a plurality of longitudinally spaced connection nodes, the interconnecting strands being rigidly joined to the first and second tension strands and extending at a nonperpendicular entry and exit angles with respect to the first and second tension strands, the interconnecting strands crossing each other between said tension strands so as to define at least one void between said tension strands;

the plurality of interconnecting strands including first, second, third and fourth interconnecting strands;

the first interconnecting strand being joined to the second tension strand at a first node on the second tension strand and bending at the entry angle so as to be joined to and coextend with the second tension strand to a second node adjacent to the first node;

the second interconnecting strand being joined to the first tension strand at a first node on the first tension strand and bending at the entry angle so as to be joined to and coextend with the first tension strand to a second node adjacent to the first node on the first tension strand;

the first and second interconnecting strands diverging from the second nodes on the first and second tension strands respectively at the exit angle and crossing each other in the central webbed portion;

the third interconnecting strand being joined to the second tension strand at the second node on the second tension strand and bending at the entry angle so as to be joined to and coextend with the second tension strand to a third node adjacent to the second node;

the fourth interconnecting strand being joined to the first tension strand at the second node on the first tension strand and bending at the entry angle so as to be joined to and coextend with the first tension strand to a third node adjacent to the second node on the first tension strand;

the third and fourth interconnecting strands diverging from the second nodes on the first and second tension strands respectively at the exit angle and crossing each other in the central webbed portion;

the tension strands and the interconnecting strands all being formed of a glass fiber reinforced resin-bonded material and a bonding resin rigidly joining each of the interconnecting strands to the first and second tension strands at the nodes;

whereby a single unitary elongated strip is formed by the tension strands and the interconnecting strands.

17. The apparatus of claim 16 comprising fifth and sixth interconnecting strands incorporated into the same open weave pattern.

18. A method of internally reinforcing a poured concrete slab comprising:

providing an elongated glass fiber reinforced strip including first and second tension strands and a plurality of interconnecting strands transversely interconnecting the first and second tension strands in an open weave pattern, the interconnecting strands being nonperpendicular to the first and second tension strands and crossing each other between said tension strands so as to define at least one void therebetween and a webbed central portion;

installing the reinforcing strip into a form for receiving wet concrete;

pouring wet concrete including aggregates therein into the form until the webbed strip is covered with the wet concrete and the wet concrete and the aggregates flow through the voids to completely surround the interconnecting strands;

allowing the wet concrete to dry and thereby fully envelop the interconnecting strands once the concrete dries.

19. The method of claim 18 wherein the installing step comprises supporting the reinforcing strip a given distance away from an inner surface of the form on a chair and tying the strip to the chair.

* * * * *